US007699088B2

(12) United States Patent
Coenraets

(10) Patent No.: US 7,699,088 B2
(45) Date of Patent: Apr. 20, 2010

(54) DOOR ASSEMBLY

(75) Inventor: Benoit Coenraets, Brussels (BE)

(73) Assignee: Dynaco International S.A., Moorsel (BE)

( * ) Notice: Subject to any disclaimer, the term of this patent is extended or adjusted under 35 U.S.C. 154(b) by 9 days.

(21) Appl. No.: 10/510,278

(22) PCT Filed: Apr. 3, 2003

(86) PCT No.: PCT/BE03/00060

§ 371 (c)(1),
(2), (4) Date: Jun. 15, 2005

(87) PCT Pub. No.: WO03/085230

PCT Pub. Date: Oct. 16, 2003

(65) Prior Publication Data

US 2005/0252619 A1 Nov. 17, 2005

(30) Foreign Application Priority Data

Apr. 10, 2002 (BE) ..... 2002/0254

(51) Int. Cl.
*E06B 3/48* (2006.01)

(52) U.S. Cl. ..... 160/113; 160/41

(58) Field of Classification Search ..... 160/113, 160/40, 41, 42, 118, 201, 98, 273.1, 272, 160/271, 209; 49/383
See application file for complete search history.

(56) References Cited

U.S. PATENT DOCUMENTS 1,716,285 A 6/1929 Szako
2,845,117 A 7/1958 Barry
3,004,592 A * 10/1961 Norton ..... 160/114
3,021,896 A * 2/1962 Buono et al. ..... 160/113
3,090,427 A * 5/1963 Stroup et al. ..... 160/40
3,103,967 A 9/1963 Gaschen
3,126,944 A * 3/1964 Kempinski ..... 160/90
4,141,403 A * 2/1979 Church ..... 160/201
4,250,941 A * 2/1981 McNally ..... 160/209
4,357,978 A * 11/1982 Keller et al. ..... 160/41
4,653,566 A * 3/1987 Miale ..... 160/201
4,712,598 A * 12/1987 Bonacci et al. ..... 160/84.06
4,771,505 A * 9/1988 Dilich ..... 16/86 A
5,050,660 A * 9/1991 Bleichwehl et al. ..... 160/113

(Continued)

FOREIGN PATENT DOCUMENTS

JP 7-11692 2/1995

(Continued)

*Primary Examiner*—David Purol
(74) *Attorney, Agent, or Firm*—Browdy and Neimark, PLLC

(57) ABSTRACT

The invention relates to a set of doors for closing off a bay (6) in a wall (4), comprising a first flexible door (1) and a second door (2) having at least a rigid bottom edge (17), it being possible to impart an upward movement and a downward movement to each of these doors (1, 2) respectively into an open position and a closed position, the second door (2) being disposed so as to create a slit (31) between the wall (4) and the rigid bottom edge (17) of this second door (2) as it is moved upwards into the open position. The flexible door (1) is disposed at least partially between said second door (2) and said wall (4) and can be displaced through said slit (31) between its closed position and its open position when the second door (2) is in the open position.

15 Claims, 9 Drawing Sheets

U.S. PATENT DOCUMENTS 5,392,835 A 2/1995 Wildt
5,408,789 A * 4/1995 Plfeger ..... 52/173.2
5,445,209 A * 8/1995 Lichy ..... 160/273.1
5,887,385 A * 3/1999 Horner et al. ..... 49/26
6,053,235 A 4/2000 Ruffner, Sr.
6,289,963 B1 * 9/2001 Vaske ..... 160/89
6,484,447 B1 * 11/2002 Snyder et al. ..... 49/499.1
6,655,440 B2 * 12/2003 Brunk ..... 160/40
6,705,378 B1 * 3/2004 Smidt ..... 160/120
7,086,442 B1 * 8/2006 Esparza ..... 160/113

FOREIGN PATENT DOCUMENTS

JP 09-268667 10/1997

* cited by examiner

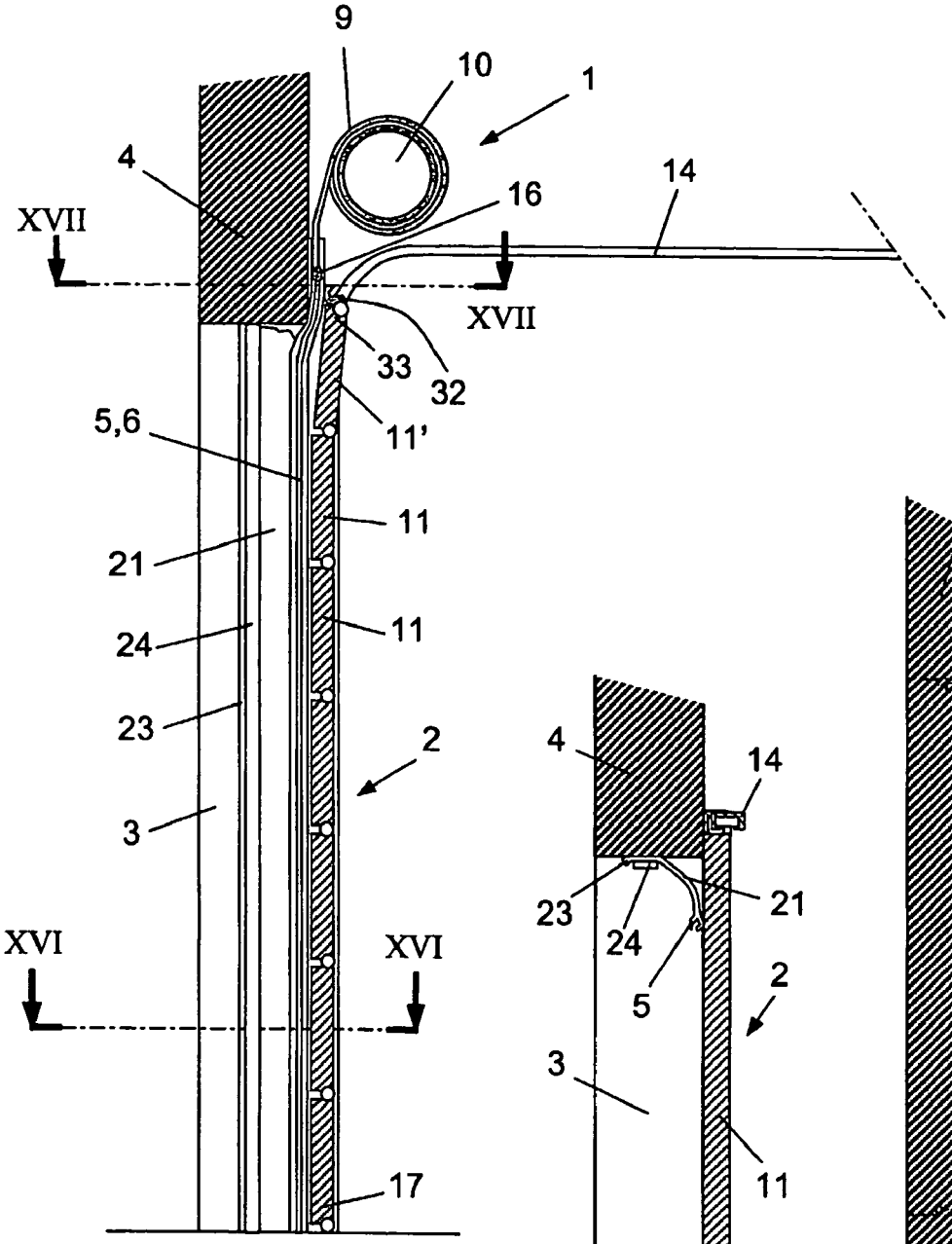
Fig. 15
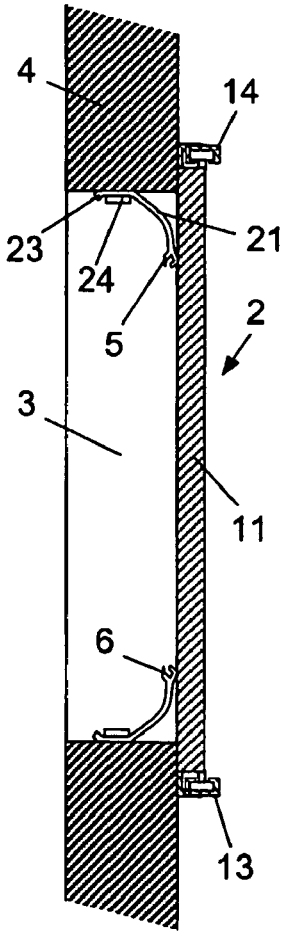
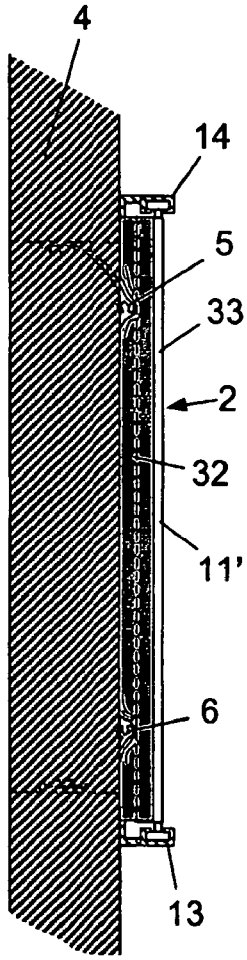
Fig. 17
Fig. 16

DOOR ASSEMBLY

FIELD OF THE INVENTION

The invention relates to a set of doors for closing off a bay in a wall, comprising a first flexible door and a second door having a rigid bottom edge, it being possible to displace each of these doors in an upward and a downward motion between an open position and a closed position, the second door being arranged so that the bottom edge moves apart from the wall during its upward motion towards the open position, creating a slit between the wall and the bottom edge of this second door.

Said second door is provided in the form of a sectional door, for example, made up of a succession of rigid sections articulated one about the other. When this second door is in its closed position, the sections and the bottom edge of the door fit against the wall, whilst in the open position, a slit is created between the part of the wall located above the bay and the bottom edge of the door.

BACKGROUND OF THE INVENTION

Currently known sets of doors are of a relatively cumbersome and complex construction. Furthermore, these known sets of doors do not enable a sealed closure to be obtained when the flexible door is in the closed position and said second door is in the open position. In particular, spaces are left, through which insects, an air flow or dust are able to penetrate the enclosure closed off by this set of doors. In practice, it is relatively complicated to make a set of doors which provides satisfactory sealing.

Document U.S. Pat. No. 2,501,454 describes a set of two doors, each of which is wound on a drum to enable them to be opened. An attempt has been made to provide a seal between the wall and the set of these doors by mounting a housing above the bay in which said drums are enclosed. Naturally, mounting such a housing is relatively complex and it is not possible to use such a housing if one of these doors is not wound on a drum. This might be the case, for example, if the second door is a rigid door or a sectional door.

SUMMARY OF THE INVENTION

One of the essential objectives of the present invention is to propose a set of doors that is rather less cumbersome and of a very simple construction. Furthermore, this set of doors must offer a very effective and simple way of obtaining complete sealing when one of the doors of this set is closed.

To this end, the invention proposes a flexible door which is arranged at least partially between said second door and the above-mentioned wall, it being possible to displace this flexible door through said slit between its closed position and its open position when the second door is in the open position.

In one specific embodiment of the set of doors proposed by the invention, when said second door is in its open position whilst said flexible door is being displaced into its closed position or into its open position, the latter, as it is displaced, is supported against a guide surface provided on the wall above the bay and/or at the bottom edge of the second door.

In one specific embodiment of the invention, the flexible door has a shutter, the side edges of which are guided relative to guide tracks crossing through said slit between the wall and the bottom edge of the second door.

Advantageously, when said second door is in the open position with said flexible door in its closed position, it is in contact with the wall above the bay and forms a seal between this wall and the flexible door on the one hand and on the other hand is supported against the bottom edge of the second door in order to maintain said contact, thereby providing the aforementioned seal.

For practical purposes, the guide tracks form a seal between the wall and said second door when it is in the closed position.

In one practical embodiment of the set of doors proposed by the invention, the bottom edge of the second door is provided with a guide surface enabling the door with the flexible shutter to slide on this edge as the shutter is moved upwards or downwards.

Advantageously, the wall located above the bay is provided with a guide surface, enabling the door with the flexible shutter to slide relative to this wall as the shutter is moved upwards or downwards.

In one very practical embodiment of the set of doors proposed by the invention, the door with the flexible shutter is provided with a sealing element extending substantially across the entire width of the flexible door, which extends between the door and the wall located above the bay when the flexible door is in the closed position, forming a seal between this wall and this door.

In a practical manner, the flexible door is provided with a sealing element extending essentially across the entire width of the flexible door which, when the flexible door is in the closed position, extends between this door and the bottom edge of the second door so that the flexible door is clamped between the wall and this bottom edge.

Other details and features of the invention will become apparent from the description given below, which is not intended to be restrictive, of various specific embodiments of a set of doors as proposed by the invention, with reference to the appended drawings.

BRIEF DESCRIPTION OF FIGURES

FIG. 15 is a diagram in section showing a set of doors in another embodiment proposed by the invention, with a sectional door in the closed position and a flexible door in the open position.

FIG. 16 is a section along line XVI-XVI indicated in FIG. 15.

FIG. 17 is a section along the line XVII-XVII indicated in FIG. 15.

The same reference numbers are used in the different drawings to denote the same or similar elements.

Generally speaking, the present invention relates to a set of doors for closing off a bay in a wall. This set of doors comprises a first flexible door and a second door, arranged one behind the other, to enable the bay to be closed off by one of these doors when the other door is open.

The use of such a set of doors is particularly practical in situations where said second door is a rigid door, the displacement of which between the closed position and the open position is relatively slow. If there is a relatively high density of people or traffic passing through this bay, opening and closing this rigid door incurs a considerable loss of time since it is necessary to wait for this rigid door to open. The presence of a flexible door which can be closed and opened at a relatively high speed eliminates this disadvantage. Accordingly, the rigid door is placed in its open position if a relatively high amount of passing traffic is expected and this door is placed in the closed position at night, when no traffic is expected.

DETAILED DESCRIPTION OF EMBODIMENTS

Using a flexible door has an additional advantage insofar as such a door requires only a relatively small amount of mounting space.

Advantageously, the flexible door has a shutter, the side edges of which preferably co-operate with guide tracks provided at either side of the bay, so that the bay can be closed off by this shutter. The word "shutter" is intended to be construed within the scope of the present invention as meaning any planar element of a slim thickness, which is at least partially pliable, flexible, optionally with one or more transverse stiffeners, such as a canvas, a screen to keep out mosquitoes or other insects, a strip of plastics material, a tarpaulin, a grill or a metal sheet, etc. . . .

However, it should be pointed out that particular preference is given to flexible shutters provided in the form of a canvas, for example.

Accordingly, the figures illustrate a shutter consisting of a canvas, the side edges of which are provided with a bead or a succession of small rigid blocks, articulated one about the other.

Figure 1:
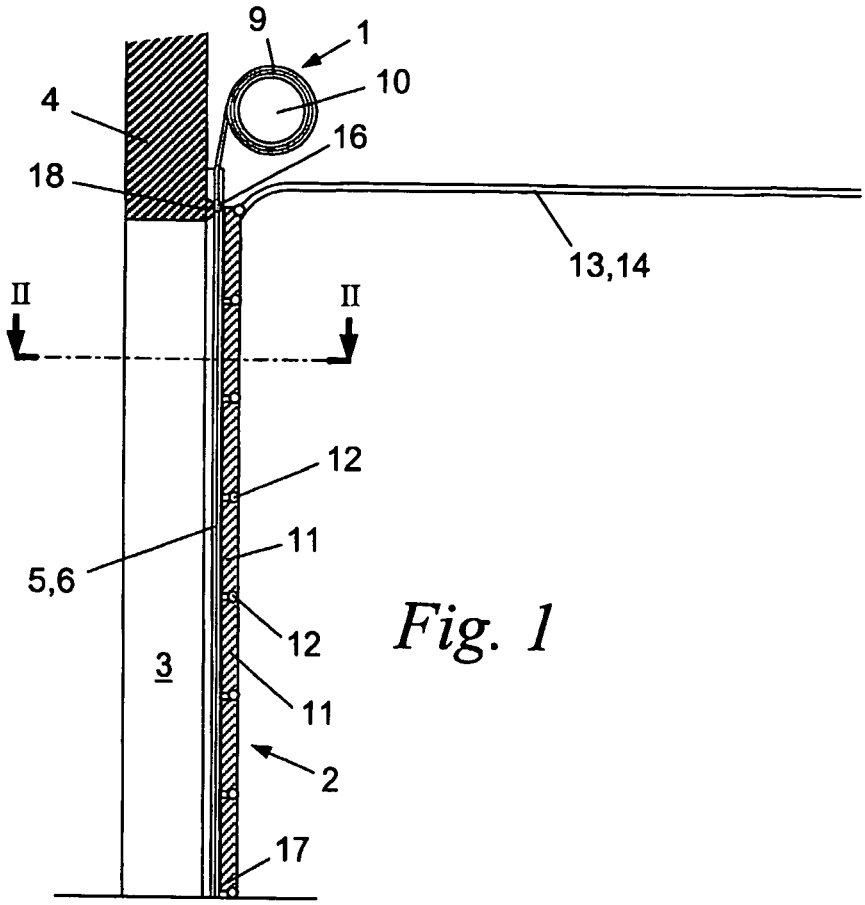
FIG. 1 is a diagram in section, showing a set of doors in a first embodiment proposed by the invention, with a sectional door in the closed position and a flexible door in the open position.
Figure 3:
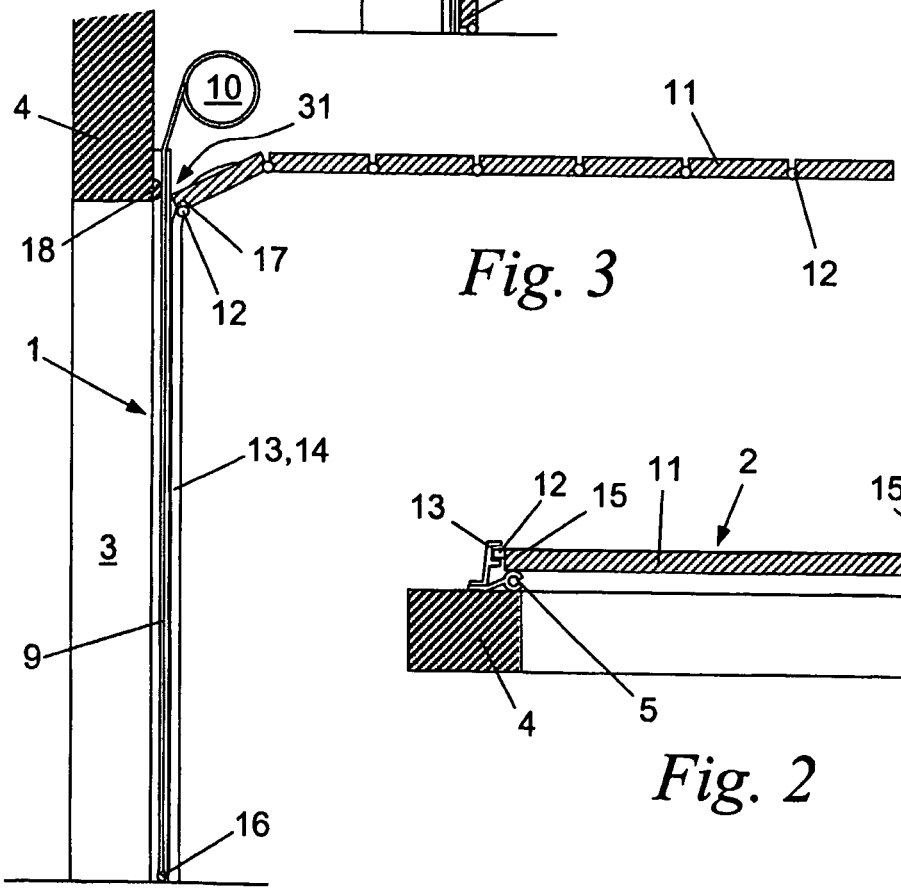
FIG. 3 is a section identical to that illustrated in FIG. 1, in which the sectional door is in the open position and the flexible door is in the closed position.
Figure 2:
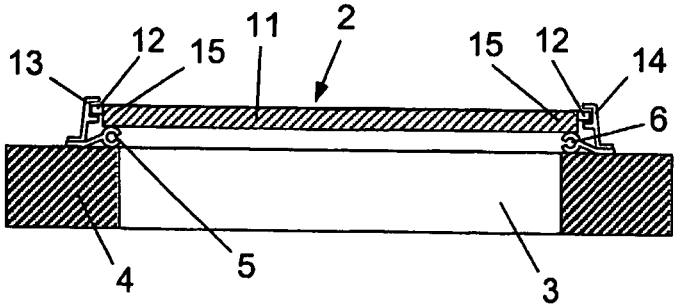
FIG. 2 is a section through line II-II indicated in FIG. 1.

FIGS. 1 to 3 illustrate a first embodiment of the set of doors proposed by the invention, comprising a flexible door 1 and a rigid door 2, which can be used to close off a bay 3 in a wall 4.

The flexible door 1 comprises a shutter 9 and two guide tracks 5 and 6 extending on either side of the bay 3, in which the side edges 7 and 8 of the shutter 9 are guided as this shutter 9 is displaced between a closed position and an open position. At a level above the bay 3, a drum 10 is provided, about which the shutter 9 is wound as it is moved into the open position or from which it is unwound as it is displaced into the closed position. Advantageously, driving means are provided for this purpose, although they are not illustrated in the drawing.

The guide tracks 5 and 6 are preferably mounted in an elastic arrangement relative to the wall 4 so that as the shutter 9 is being displaced into the closed position, these guide tracks 5 and 6 are automatically moved towards one another to ensure that the distance between them corresponds to the width of the shutter 9. When the flexible door 1 is open and the shutter 9 is therefore wound around the drum 10, the guide tracks 5 and 6 automatically recoil so as to be spaced at a distance apart, due to their elastic mounting, so that they are not in the bay 3.

The rigid door 2, which is provided as a sectional door comprising a succession of sections 11 articulated one about the other, mainly extends along the flexible door 1 in such a way that the latter is arranged between this rigid door 2 on the one hand and the bay 3 and the wall 4 on the other.

At the point where the sections 11 are articulated one about the other, rollers 12 are provided, which are guided in matching guide tracks 13 and 14. These guide tracks 13 and 14 extend substantially vertically on either side of the bay 3, curve on a level with the top part of the bay 3 and then extend transversely relative to the wall 4.

The guide tracks 5 and 6 of the flexible door 1 are disposed between the guide tracks 13 and 14 of the rigid door 2 and the wall 4.

Accordingly, the guide tracks 5 and 6 of the flexible door 1 form a seal between the wall 4 and the rigid door 2 when the latter is in the closed position, as schematically illustrated in FIG. 2. In particular, when the rigid door is in the closed position, the side edges of the sections 11 are supported against the guide tracks 5 and 6 of the flexible door 1, preferably slightly compressing these guide tracks 5 and 6, which are made from a slightly elastic material.

When the flexible door 1 is in the open position, the bottom edge 16 of the shutter 9 is disposed above the bay 3 between the top section 11 of the rigid door 2 and the wall 4, thereby forming a seal between the rigid door and the wall 4 located above the bay 3. In particular, the bottom edge 16 of the shutter 1 is clamped between the wall 4 and the corresponding section 11 of the rigid door when the latter is in its closed position. For this reason, the bottom edge 16 of the shutter 1 preferably has an elastic bead extending across substantially the entire width of the shutter 1.

As the rigid door 2 is opened, the bottom edge 17 of this door is moved slightly away from the wall 4 so that the shutter 9 of the flexible door can be readily displaced through the slit 31 thus created between the wall 4 and the bottom edge 17 of the rigid door 2. This slit 31 therefore appears only when the rigid door 2 is open and is not present when this door is closed.

When the rigid door 2 is in the open position and the flexible door 1 is in the closed position, it is important that the latter should be in a position to provide a sealed closure of the bay 3. To this end, the part of the shutter 1 extending in the region of the bottom edge 17 of the rigid door, when the latter is in the open position, can be supported against this bottom edge 17. This therefore prevents any space from being formed between the shutter 9 and the wall 4 above the bay 3. Such a space might be produced if the shutter 9 were moved away from the wall 4 above the bay 3 when subjected to a flow of air or slight pressure, for example.

In order to ensure that the shutter 9 remains in permanent contact with the wall 4 above the bay 3 when the flexible door is in the closed position, a guide surface is advantageously provided on this wall 4, extending across substantially the entire width of the shutter 1. This guide surface is provided in the form of a thickened section 18, for example, disposed at the point above the bay 3 where the shutter 1 comes into contact with the wall 4. Consequently, this thickened section on the one hand ensures that the shutter 9 slides with a minimum of friction as the shutter is being closed or opened and on the other hand provides a seal between the shutter 9 and the wall 4.

Similarly, a guide surface may be provided on the bottom edge 17 of the rigid door 2, to enable the shutter 9 to slide on this bottom edge 17 as the shutter 9 is moved down or up.

Figures 4, 6:
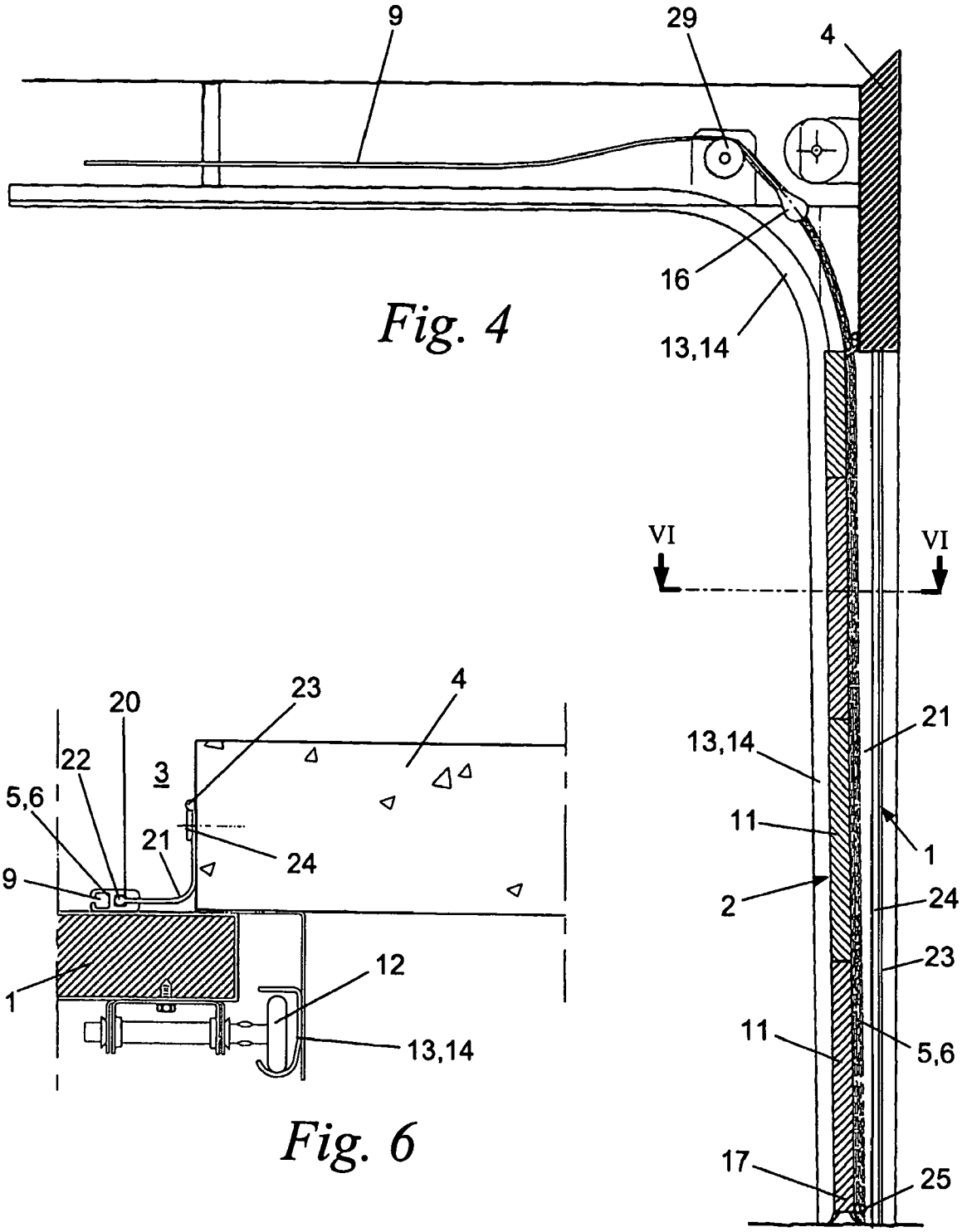
FIG. 4 is a diagram in section, showing a set of doors in a second embodiment proposed by the invention, with a sectional door in the closed position and a flexible door in the open position.
FIG. 6 is a diagram in section, on a larger scale, along line VI-VI indicated in FIG. 4.
Figures 5, 7:
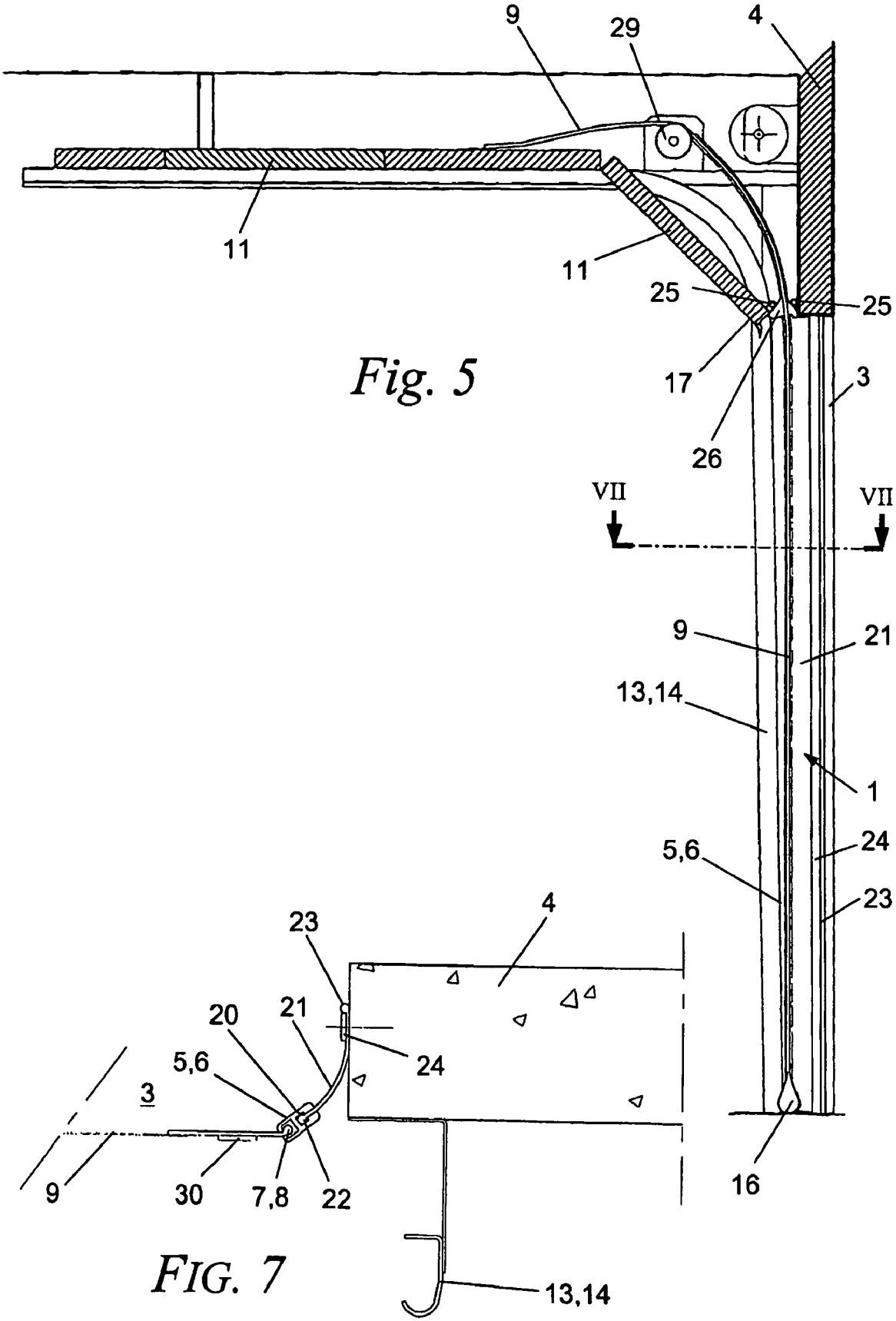
FIG. 5 is a section identical to that shown in FIG. 4, in which the sectional door is in the open position and the flexible door is in the closed position.
FIG. 7 is a diagram in section, on a larger scale, along line VII-VII indicated in FIG. 5.
Figure 8:
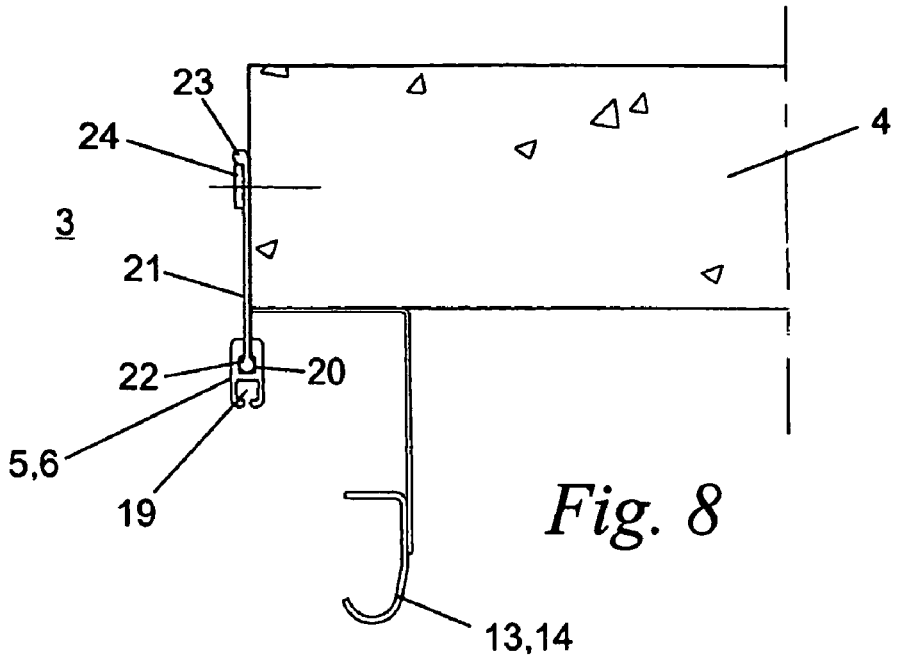
FIG. 8 is a diagram in section identical to that of FIGS. 6 and 7, in which the flexible door and the sectional door are in the open position.

FIGS. 4 to 11 illustrate a second embodiment of the set of doors proposed by the invention, with a conventional sectional door and a flexible door 1, in which the guide tracks 5 and 6 of the latter are mounted in the bay 3. This is illustrated in FIGS. 6, 7 and 8.

The guide tracks 5 and 6 of the flexible door specifically comprise a profiled section with two parallel flanges linked to one another in their longitudinal direction by a central cross-piece, this section thus having a H-shaped cross section. The edges of one of the flanges are bent towards the facing edges of the other flange so as to form two channels 19 and 20. The corresponding edge 7 or 8 of the shutter 9 can be displaced in one of these channels 19 during opening or closure of the flexible door 1 whilst a mounting strip 21 is fixed in the other channel 20.

This mounting strip 21 is mounted in the bay 3 on the wall 4. As illustrated in the drawings, the mounting strip 21 has side edges 22 and 23 which are thicker than the part of the strip 21 disposed between these edges 22 and 23. The mounting strip 21 is mounted in the region of an edge 23 on the wall in the bay 3 by means of a mounting batten 24 so that the mounting strip 21 is clamped between the mounting batten 24 and the wall 4. The other edge 22 of the mounting strip 21 is retained in the corresponding channel 20 of said section.

The mounting strip 21 is made from a flexible and preferably elastic material, such as an elastomer, polypropylene or polyurethane. Said section is preferably made from a relatively flexible material to enable this section to bend and flex slightly and maintain a uniform tension on the shutter.

When the flexible door 1 and the rigid door 2 are open, as illustrated in FIG. 8, the mounting strip 21 is extended so that it is located outside the bay 3.

When the flexible door 1 is being closed by the downward movement of the shutter 9, the width of which is shorter than the width of the bay 3, the sections at the two sides of the bay 3 are gradually moved closer to one another, flexing the corresponding mounting strips 21. This is illustrated in FIG. 7. Given that the mounting strips 21 have a tendency to extend, the shutter 9 always remains substantially taut when it is in the closed position.

When the flexible door 1 is being opened by the upward movement of the shutter 9, the mounting strips 21 gradually resume their extended position, as illustrated in FIG. 8.

When the flexible door 1 is open and the rigid door is in the closed position, as illustrated in FIG. 6, the mounting strip 21 is flexed and is supported, with said section, against the surface of the sections 11 of the rigid door 2. The mounting strip 21 and this section therefore form a seal between the wall 4 and the rigid door 2.

Figure 10:
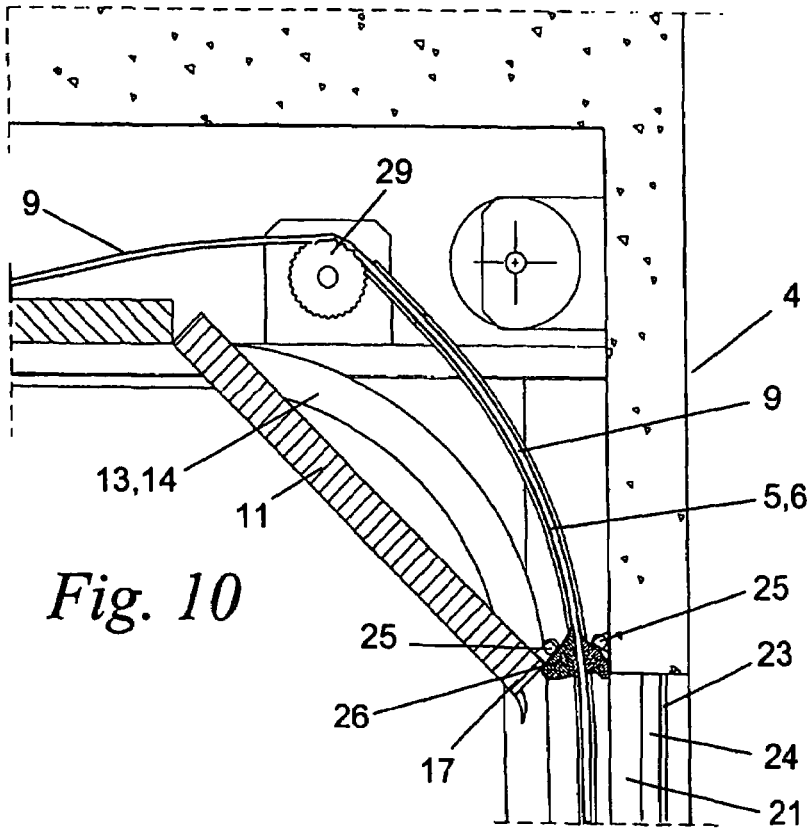
FIG. 10 is a detail showing the part of the set of doors illustrated in FIG. 5 above the bay.

FIGS. 5 and 10 illustrate the set of doors proposed by the invention, with the rigid door in the open position and the flexible door in the closed position. The bottom edge 17 of the rigid door 2 is provided with a guide surface in the form of a cylinder 25, which may optionally undergo a rotation about its axis, and which extends along this bottom edge 17 across a distance substantially corresponding to the width of the shutter 9. In a practical manner, this cylinder 25 is provided in the form of a succession of coaxial rollers. This guide surface enables the shutter 9 to slide against this bottom edge 17 of the rigid door 2 with minimum friction as the shutter 9 is moved into its closed position or open position.

In addition, the shutter 9 is supported against this guide surface, or in particular against the cylinder 25, when it is closed, preventing a space from being formed between shutter 9 and the part of the wall 4 located above the bay 3.

This part of the wall 4 located above the bay 3 is also provided with a guide surface in the form of a cylinder 25, on which the shutter 9 is able to slide as it is displaced into the closed or open position.

In order to ensure that a seal is provided between the shutter 9 and the bottom edge 17 of the rigid door 2 on the one hand and the wall 4 located above the bay 3 on the other, the shutter 9 is provided with a sealing element 26. This sealing element 26 extends substantially across the entire width of the shutter 9 at the point of the latter facing the bottom edge 17 of the rigid door 2 when the latter is in its open position and the flexible door 1 is in the closed position.

Accordingly, this sealing element 26 is clamped between the bottom edge 17 of the rigid door and the part of the wall 4 above the bay 3, thus providing the desired seal.

Figure 12:
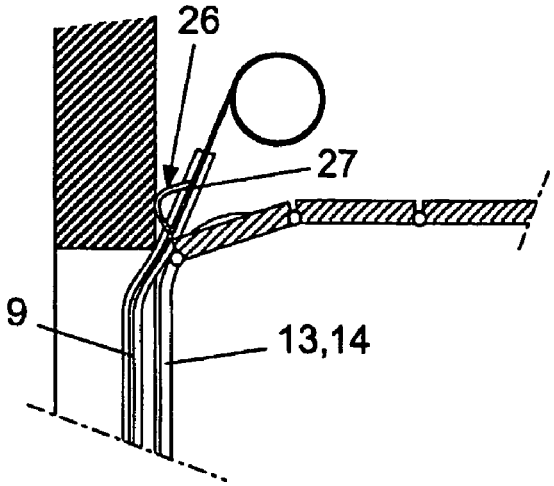
FIG. 12 is a detail of the part above the bay showing the set of doors, in which the flexible door is provided with a flap and is in the closed position.

The sealing element 26 may be provided in the form of a compressible flap 27, as illustrated very schematically in FIG. 12. This flap 27 flattens out as the shutter 9 is wound on the drum 10 in order to open the bay 3 and reverts to its initial shape as the shutter is unwound from the drum 10 into its closed position.

Figure 13:
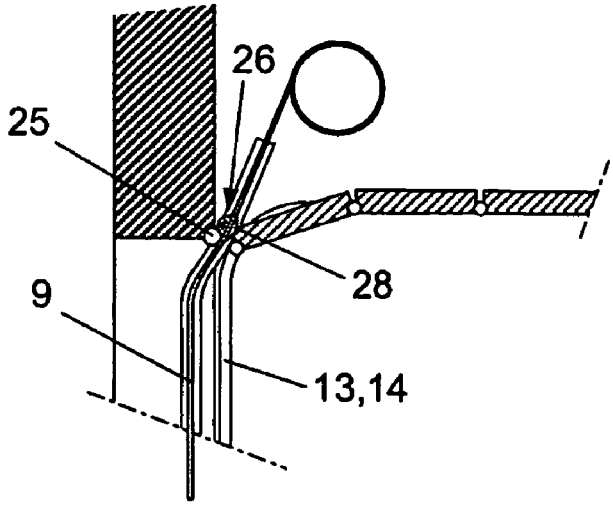
FIG. 13 is a detail of the part above the bay showing the set of doors, in which the flexible door is provided with a thickened section and is in the closed position.

FIG. 13 illustrates an alternative embodiment of the sealing element 26. The sealing element specifically consists of a bead 28 made from an elastic material, which is clamped between the wall and the bottom edge of the second door when the latter is in the open position, whilst said flexible door is in its closed position.

To enable the shutter 9 to be displaced in an upward and downward movement, driving means are provided, consisting of a rack wheel 29 co-operating with a rack 30 extending along the side edge of the shutter, as illustrated very schematically in FIG. 7. The rack wheel 29 is located above the guide tracks 13 and 14 of the rigid door 2 and is controlled by an electric motor, not illustrated.

Figure 11:
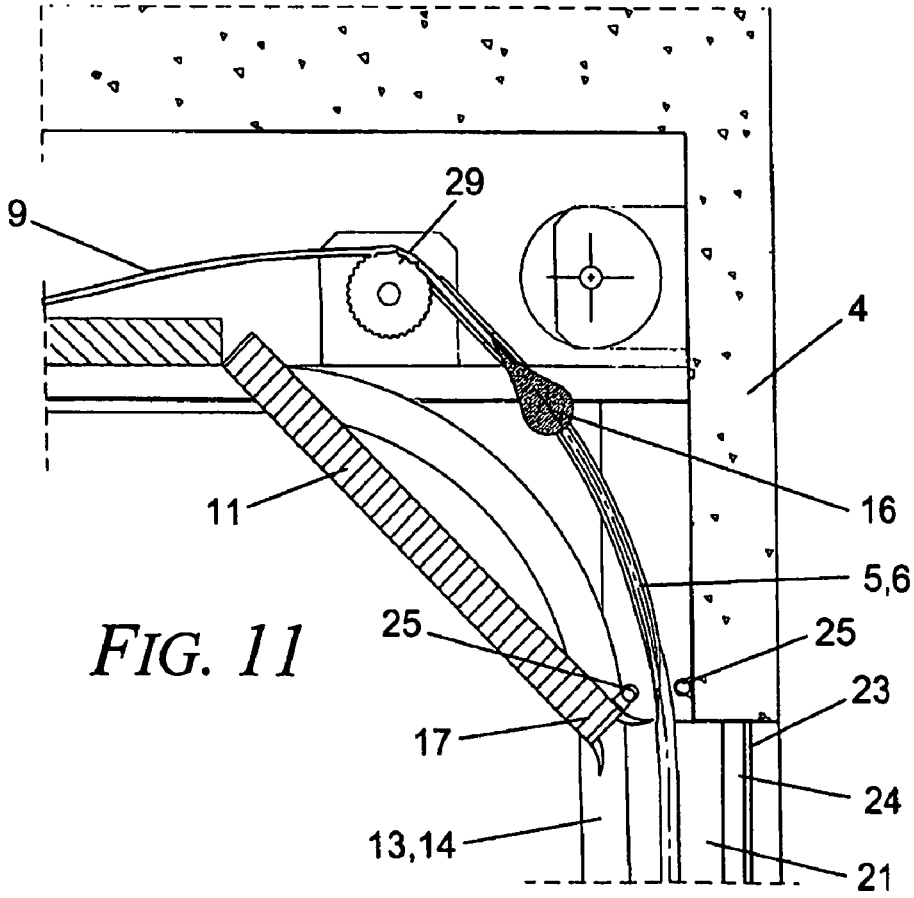
FIG. 11 is a detail of the part above the bay, showing the embodiment of the set of doors proposed by the invention illustrated in FIGS. 4 to 10, in which the flexible door and the sectional door are in the open position.
Figure 9:
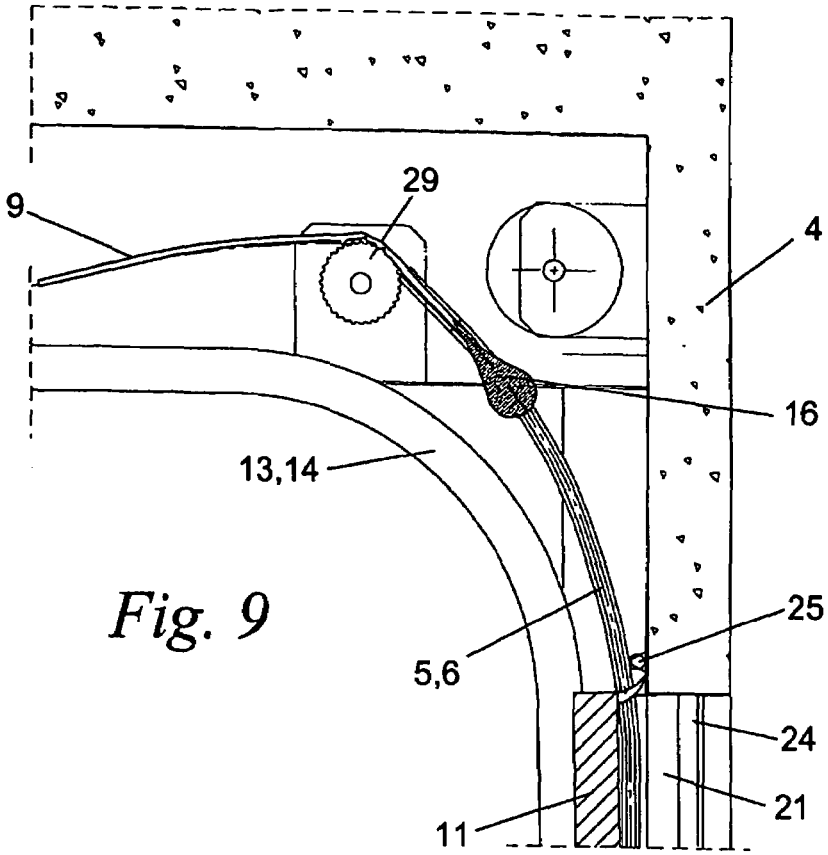
FIG. 9 is a detail showing the part of the set of doors illustrated in FIG. 4 above the bay.
Figure 14:
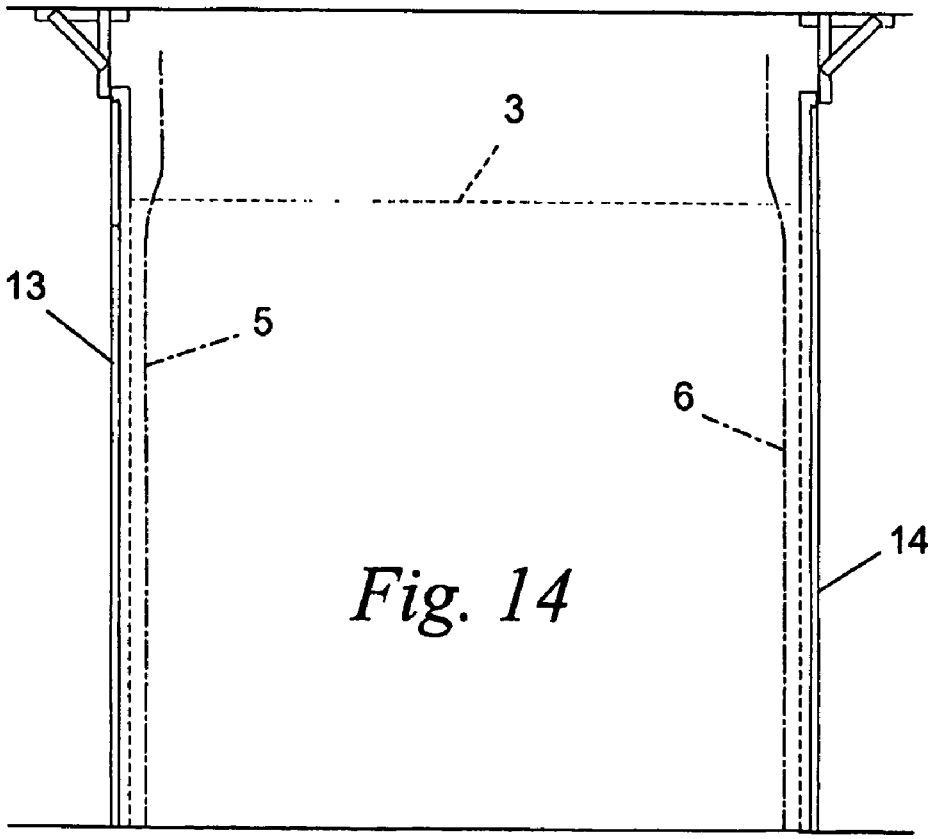
FIG. 14 is a very schematic front view of the set of doors proposed as a second embodiment of the invention.

The guide tracks 5 and 6 of the flexible door 1 extend as far as the region in the vicinity of this rack wheel 29. Since the width of the shutter 9 is shorter than the distance between the guide tracks 5 and 6 by which the shutter 9 is guided, these guide tracks 5 and 6 are slightly twisted together in the region between the bay 3 and the rack wheel 29 when the flexible door 1 and the rigid door 2 are in their open position. The bottom part of the shutter 9 and the bottom edge 16 are always retained in the guide tracks 5 and 6. This is schematically illustrated in FIGS. 11 and 14. The dotted-dashed lines in FIG. 14 specifically illustrate the path of the guide tracks of the flexible door 1, whilst the bay 3 is indicated by broken lines.

As the flexible door 1 is being opened, the shutter 1 can be wound on the drum or the shutter 9 may be extended above the horizontal part of the guide tracks 13 and 14 of the rigid door, as illustrated very schematically in FIGS. 4 to 11.

In a very practical manner, the set of doors proposed by the invention may be set up using an existing door with at least one rigid bottom edge. For example, if a sectional door is provided in front of a bay, it is possible to mount a flexible door between this existing door and the wall. In particular, when an upward movement is imparted to the sectional door to bring it into its open position, this sectional door moves away from the wall, thus creating a slit between the wall above the bay and the bottom edge of the door in its open position. This slit is generally of a width in the order of 1 to 4 cm.

The set of doors proposed by the invention is then set up by mounting two guide tracks for the flexible door on either side of the bay, extending through said slit between the bottom edge of the sectional door and the part of the wall located above the bay. A drum for winding a shutter is mounted on the wall above the bay, for example, so that the shutter can be displaced through said slit between a closed position and an open position when the sectional door is in the open position.

Accordingly, a flexible door is mounted, which co-operates with the sectional door, maintaining the original height of the passage underneath the sectional door when the latter is in its open position.

Figure 18:
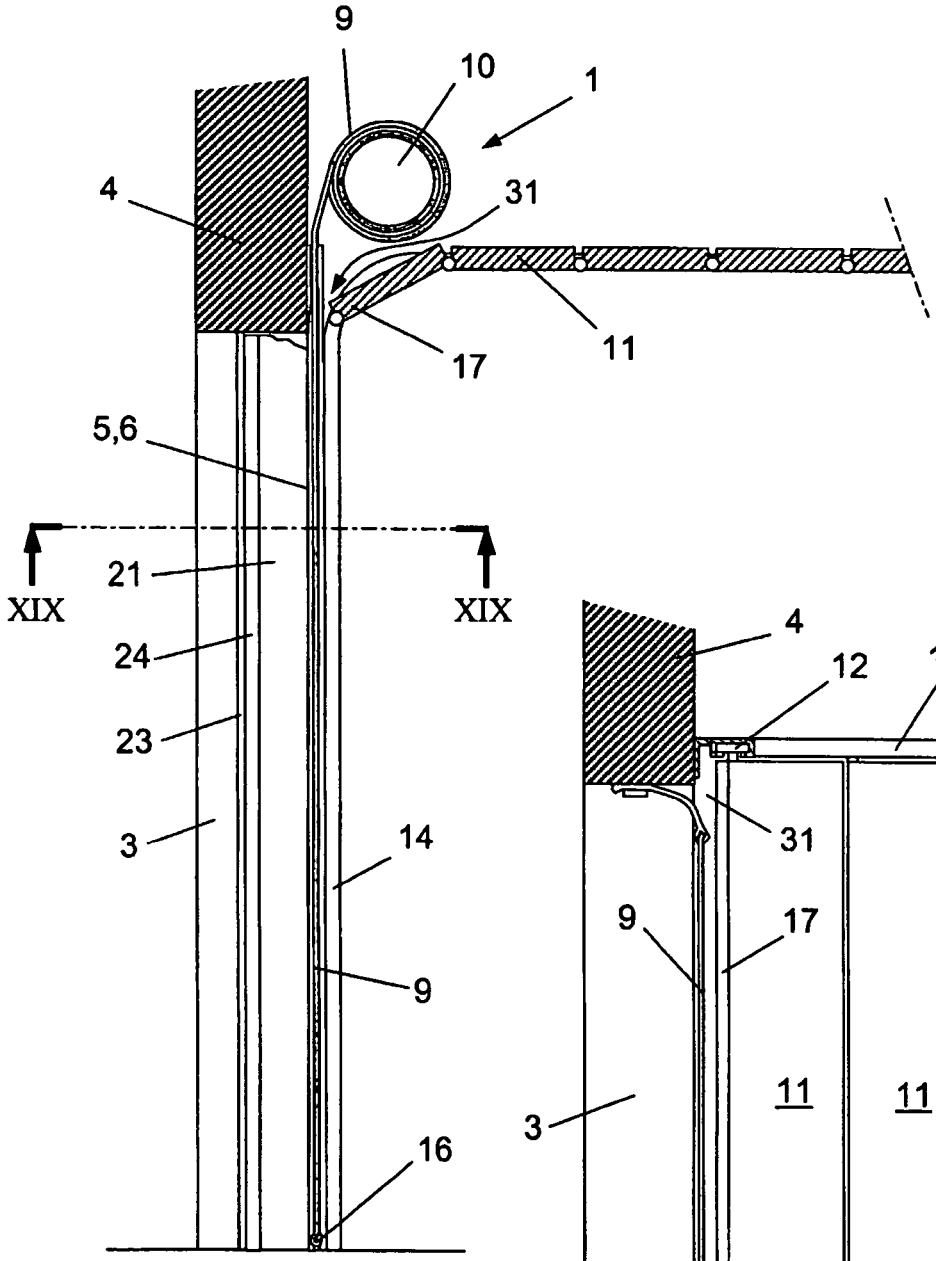
FIG. 18 is a diagram in section of the set of doors illustrated in FIGS. 15 to 17, when the sectional door is in the open position and the flexible door is in the closed position.
Figure 19:
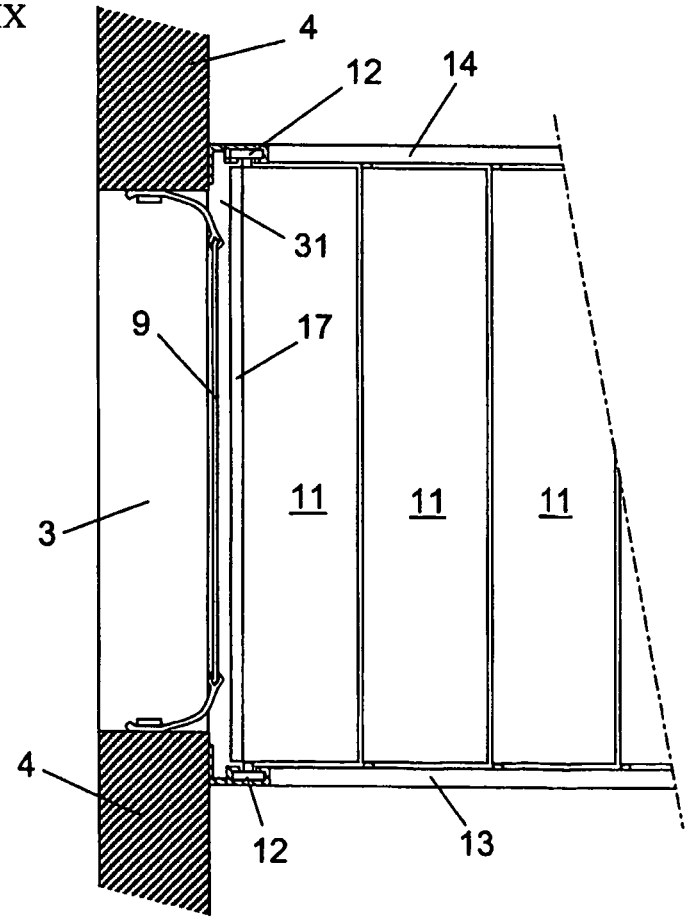
FIG. 19 is a section along the line XIX-XIX indicated in FIG. 18.

FIGS. 15 to 19 illustrate such a set of doors. As illustrated in FIGS. 15 and 16, when the sectional door 2 is in the closed position, it extends against the wall 4 around the bay 3, forming a seal between this wall 4 and the sectional door 2. As the sectional door 2 is moved upwards into the open position, the sections 11 of this door gradually move away from the wall 4. Consequently, as explained above, a slit 31 is created between the wall 4 and the bottom edge 17 when the sectional door is in the open position, as illustrated in FIGS. 17 and 18.

The flexible door 1, comprising a shutter 9 in the form of a canvas, is mounted between the sectional door 2 and the wall 4 so that the guide tracks 5 and 6 of the flexible door 1 extend through said slit 31 and is displaced through the slit 31 as the shutter 9 is moved upwards or downwards between its closed position and its open position.

In the embodiment of the invention illustrated in FIGS. 15 to 19, the guide tracks 5 and 6 of the flexible door 1 are mounted in the same manner as described with reference to FIGS. 4 to 11.

When the sectional door 2 is in its closed position, the top section 11' of this door is slightly inclined relative to the wall 4. Accordingly, a space is formed between the wall 4 and this top section 11', through which the guide tracks 5 and 6 of the flexible door 1 extend.

At the top edge 33 of the top section 11', a flexible seal 32 is provided, extending along this section 11' between the latter and the wall 4 when the sectional door 2 is in its open position. When the sectional door 2 is closed, this seal is elastically deformed at the point where the guide tracks 5 and 6 of the flexible door 1 pass through the space between the wall 4 and the sectional door 2, as schematically illustrated in FIG. 17. Accordingly, a seal is obtained between the top section 11' of the sectional door 2 and the wall 4, even though the guide tracks 5 and 6 of the flexible door 1 are disposed between this section 11' and the wall 4.

Naturally, the top section 11' need not necessarily be inclined relative to the wall 4 when the sectional door 2 is in the closed position. For example, a cutout may be provided in this top section 11' or in the wall 4 in the region of the guide tracks 5 and 6 of the flexible door 1 where the latter are accommodated when the sectional door 2 is in its closed position.

Since the slit 31 between the wall 4 and the bottom edge 17 of the sectional door 2 is used to guide the shutter 9 of the flexible door 1, the driving means, comprising a drum 10, for the flexible door 1 may be mounted above the sectional door 2. Accordingly, the original height of the passage through the bay 3 underneath the sectional door 2 is not reduced by mounting a flexible door as proposed by the invention.

Figure 20:
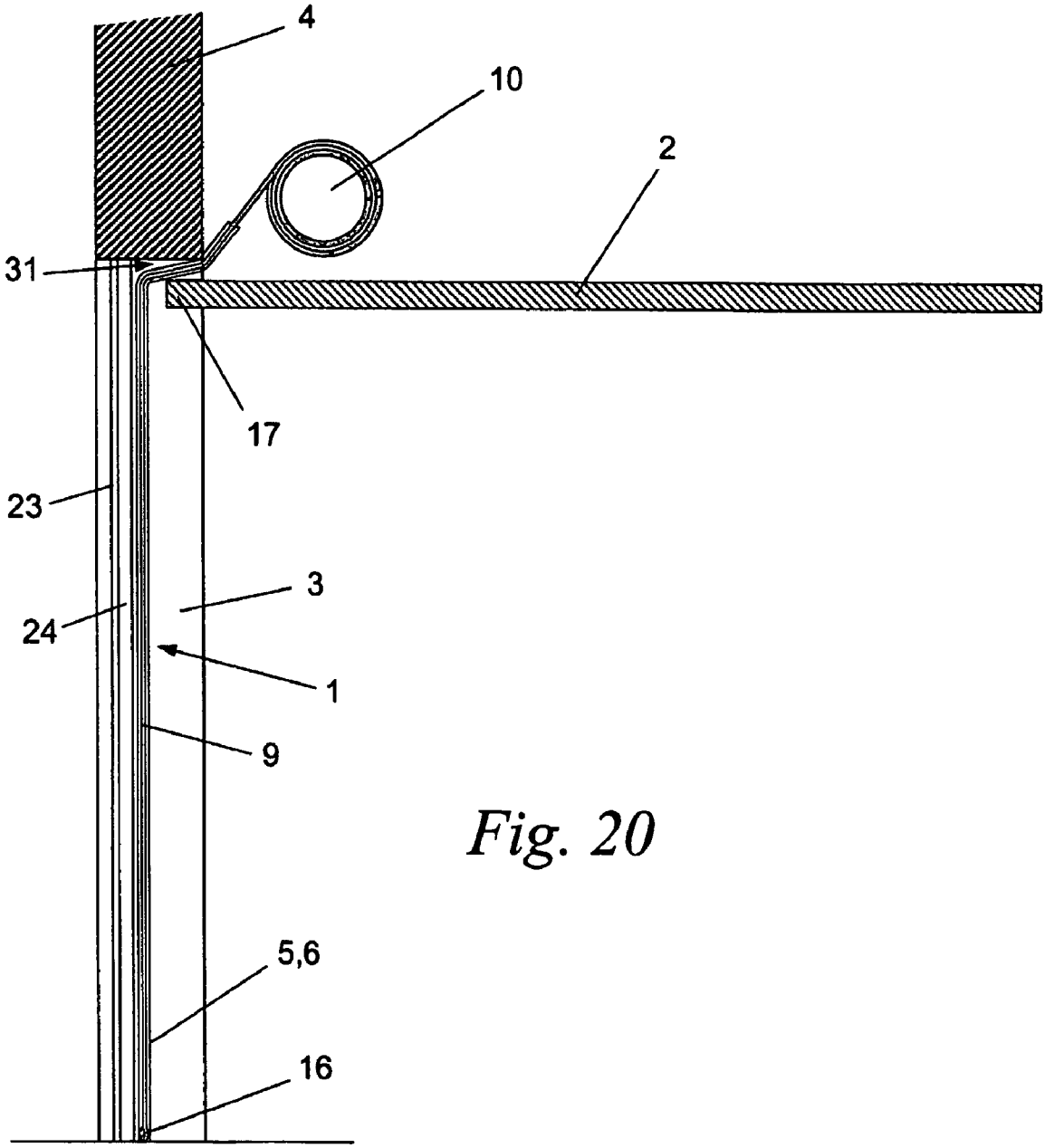
FIG. 20 is a diagram in section showing a set of doors as proposed by the invention, comprising a pivoting door and a flexible door.

FIG. 20 illustrates another embodiment of a set of doors as proposed by the invention. This set of doors comprises a flexible door 1 and a rigid door 2, consisting in particular of a conventional pivoting door such as used to close a garage, for example. When this rigid door 2 is closed, it conforms to the wall 4 in the bay 3 in a sealing arrangement, whereas when this rigid door 2 is open, as illustrated in FIG. 20, a slit 31 appears between the rigid bottom edge 17 of the latter and the part of the wall 4 located above the bay 3.

Guide tracks 5 and 6 are mounted in the bay 3 and extend through said slit 31. When the shutter 9 of the flexible door 1 is displaced between the open position and the closed position, the latter is supported against the bottom edge 17 of the rigid door 2 and against the wall 4 above the bay 3. Accordingly, the shutter 9 is guided through the slit 31.

In an alternative embodiment of the set of doors proposed by the invention, a flexible sealing flap is provided, which is mounted along the rigid bottom edge 17 of the second door 2. When the second door is in the open position, this flap seals the slit 31 between the rigid bottom edge 17 and the wall 4. As the shutter 9 of the flexible door 1 is moved downward into its closed position, this flap is flexed due to the action of the bottom edge 16 of the shutter 9 so that the latter is guided between the wall 4 and the flap.

When the second door is in the closed position, the flap forms the seal between the bottom edge 17 of this door and the ground.

Naturally, the invention is not limited to the embodiments described above and illustrated in the appended drawings and other variants would be conceivable without departing from the scope of the present invention.

For example, the aforementioned profiled section and the mounting strip 21 may be an integral piece.

Although the embodiments described all relate to a set of doors with a first flexible door and a second door provided as a sectional door or pivoting door, it is clear that this second door may be a door of any type having a rigid or semi-rigid bottom edge. In particular, this second door might be a flexible door with a rigid bottom edge, for example.

Under certain circumstances, the guide track 5 or 6 of the flexible door may be provided in the form of a bead, around which the corresponding side edge 7 or 8 of the shutter 9 conforms.

The invention claimed is:

1. Wall with a set of doors for closing off a bay (3) in this wall (4), comprising a first flexible door (1) and a second door (2) having at least a rigid bottom edge (17), each of these doors being movable between an open position and a closed position through, respectively, an upward movement and a downward movement, a slit (31) being provided between the wall (4) and the rigid bottom edge (17) of the second door (2) as this second door is moved upwards into the open position, the flexible door (1) at least partially being arranged between said second door (2) and said wall (4), wherein when the second door (2) is in the open position the flexible door (1) is movable through the slit (3) between the open position and the closed position of the flexible door, Wherein when the second door (2) is in the open position and the flexible door (1) is in its closed position the flexible door (1) is in contact with the wall (4) above the bay (3) to form a seal between the wall (4) and the flexible door (1), and the flexible door (1) is supported against the bottom edge (17) of the second door (2) in order to maintain said contact and seal.

2. Wall with a set of doors as claimed in claim 1, wherein the flexible door (1) has a sealing element (26) fixed thereto and extending across substantially the entire width of the flexible door (1), which sealing element extends between this door (1) and a part of the wall (4) located above the bay (3), the sealing element forming a seal between the wall (4) and the flexible door (1) when the flexible door (1) is in the closed position.

3. Wall with a set of doors as claimed in claim 1, wherein the flexible door has a sealing element (26) fixed thereto and extending along substantially the entire width of the flexible door (1) which extends between this door (1) and the bottom edge (17) of the second door (2) so that the flexible door (1) is clamped between the wall (4) and this bottom edge (17) when the flexible door is in the closed position.

4. Wall with a set of doors as claimed in claim 2, wherein the sealing element (26), which is fixed to the flexible door, is a thickened section (28) of an elastic material, the sealing element being clamped between the wall (4) and the bottom edge (17) of the second door (2) when the second door is in the open position and when said flexible door (1) is in its closed position.

5. Wall with a set of doors as claimed in claim 1, wherein, when said second door (2) is in the open position, as said flexible door (1) is displaced towards its closed position or towards its open position, the flexible door is supported against a guide surface on the wall (4) above the bay (3) or on the bottom edge (17) of the second door (2).

6. Wall with a set of doors as claimed in claim 5, characterised in that the bottom edge (17) of the second door (2) is provided with said guide surface (25), such that the flexible door slides on this edge (17) as the flexible door is moved upwards or downwards.

7. Wall with a set of doors as claimed in claims 5 or 6, wherein a part of the wall (4) located above the bay (3) has said guide surface (25) such that the flexible door (1) slides relative to this wall (4) as it is moved upwards or downwards.

8. Wall with a set of doors as claimed in claim 6, wherein the guide surface comprises at least one cylinder (25) with an axis which extends substantially transversely to the direction of displacement of the flexible door (1) as it is moved downwards or upwards.

9. Wall with a set of doors as claimed in claim 1, wherein the flexible door (1) comprises a shutter (9) with side edges (7, 8) that are guided relative to guide tracks (5, 6) passing through said slit between the wall (4) and the bottom edge (17) of the second door (2).

10. Wall with a set of doors as claimed in claim 9, wherein said guide tracks (5, 6) extend at least partially in the bay (3) or at the side of the bay that is directed towards the second door (2).

11. Wall with a set of doors as claimed in claim 9 or 10, characterised in that the guide tracks (5, 6) are elastically or pivotably mounted to the wall (4).

12. Wall with a set of doors for closing off a bay (3) in this wall (4), comprising a first flexible door (1) and a second door (2) having at least a rigid bottom edge (17), each of these doors being movable between an open position and a closed position through, respectively, an upward movement and a downward movement, a slit (31) being provided between the wall (4) and the rigid bottom edge (17) of the second door (2) as this second door is moved upwards into the open position, the flexible door (1) at least partially being arranged between said second door (2) and said wall (4), wherein the flexible door (1) is movable through the slit (3) between the open position and the closed position of the flexible door when the second door (2) is in the open position, wherein the flexible door is supported against the bottom edge (17) of the second door (2) when this second door (2) is in the open position and the flexible door (1) is in its closed position, wherein the flexible door (1) comprises a shutter (9) with side edges (7, 8) that are guided relative to guide tracks (5, 6) passing through said slit between the wall (4) and the bottom edge (17) of the second door (2), wherein the guide tracks (5, 6) constitute seals between the wall (4) and said second door (2) when the latter is in the closed position.

13. Wall with a set of doors for closing off a bay (3) in this wall (4), comprising a first flexible door (1) and a second door (2) having at least a rigid bottom edge (17), each of these doors being movable between an open position and a closed position through, respectively, an upward movement and a downward movement, a slit (31) being provided between the wall (4) and the rigid bottom edge (17) of the second door (2) as this second door is moved upwards into the open position, the flexible door (1) at least partially being arranged between said second door (2) and said wall (4), wherein the flexible door (1) is movable through the slit (3) between the open position and the closed position of the flexible door when the second door (2) is in the open position, wherein the bottom edge (16) of the flexible door (1) has an elastic bead extending across its entire width, said elastic head being clamped between the wall (4) and the second door (2) when the flexible door (1) is in its open position and the second door (2) is in its closed position.

14. Wall with a set of doors as claimed in claim 13, wherein a guide surface (25) is provided on the bottom edge (17) of the second door (2) whereby the flexible door (2) slides on this bottom edge (17) as it is moved upwards or downwards.

15. Wall with a set of doors as claimed in claims 13 or 14, wherein a guide surface (25) is provided on the wall (4) above the bay (3) enabling the flexible door (1) to slide relative to this wall (4) as it is moved upwards or downwards.

* * * * *